United States Patent [19]

Green

[11] 4,210,9

[45] Jul. 8, 19

[54] EYELET CLAMP FOR SHOES

[76] Inventor: Robert L. Green, 2744 N. 60th St., Scottsdale, Ariz. 85257

[21] Appl. No.: 1,223

[22] Filed: Jan. 5, 1979

[51] Int. Cl.[2] ..... A44B 21/00

[52] U.S. Cl. ..... 24/73 ES; 24/143 A

[58] Field of Search ..... 24/73 GC, 73 ES, 73 BH, 24/140, 143 A, 143 B, 143 R

[56] References Cited

U.S. PATENT DOCUMENTS

| | | | |
|---|---|---|---|
| 878,719 | 2/1908 | Gardyne | 24/143 B |
| 1,530,314 | 3/1925 | Ford | 24/73 GC |
| 1,823,057 | 9/1931 | Marx | 24/14 |
| 3,382,546 | 5/1968 | Palmay et al. | 24/73 |

FOREIGN PATENT DOCUMENTS

| | | | |
|---|---|---|---|
| 958758 | 9/1949 | France | 24/14 |
| 24417 | of 1905 | United Kingdom | 24/14 |

*Primary Examiner*—Kenneth Downey

*Attorney, Agent, or Firm*—Warren F. B. Lindsley

[57] ABSTRACT

A resilient securing, fastening or gripping means eyelets of shoes for men, women and children replaci ordinary shoe laces.

4 Claims, 10 Drawing Figures

EYELET CLAMP FOR SHOES

BACKGROUND OF THE INVENTION

This invention relates to resilient securing, fastening or gripping means which fits between the eyelets of men, women and children's shoes to replace the ordinary shoe laces.

DESCRIPTION OF THE PRIOR ART

Although the prior art has disclosed resilient fastening means for use between eyelets of a shoe thereby replacing the ordinary shoe laces, none of the known art have disclosed a resilient gripping means that is adaptable at the time of installation by the wearer to fit his particular shoes whether man, woman or child, and also fit to his or her satisfaction the particular size of eyelets in question. It should be realized that the span between each pair of eyelets may be and probably is different even on the same shoe and the diameter of the eyelet may be different on different shoes.

U.S. Pat. No. 562,114 discloses a shoe fastening means which embodies two pre-bent hooks interconnected by an elastic band.

U.S. Pat. No. 794,128 discloses an elastic lace or cord having metallic catches at opposite ends employing tubular clamps in which the ends of the cord are inserted.

U.S. Pat. No. 1,966,135 discloses a resilient grip member for shoes having a disc at each end of the grip member adapted to rest against the material around the eyelet in the shoe.

U.S. Pat. No. 2,289,225 discloses an elastic strand having integral ball heads on the ends of the strands and a bendable hook projecting from one of the heads and engageable in an eyelet in a shoe.

U.S. Pat. No. 3,701,572 discloses a stretchable shoe string.

This application discloses an improvement over the subject matter in applicant's U.S. Pat. application, Ser. No. 904,572, filed May 10, 1978 now U.S. Pat. No. 4,149,621 and entitled ADJUSTABLE RESILIENT EYELET CLAMP FOR SHOES.

SUMMARY OF THE INVENTION

In accordance with the invention claimed, an improved resilient or elastic shoe fastener is disclosed employing metallic or plastic plates on a common side and at each end of the fastener. This fastener forms at like ends of the plates a gap between the resilient or elastic member of the fastener and each of the plates for receiving in each of the gaps a portion of one of two associated spaced eyelets of the shoe so as to hold the fastener tightly to the shoe.

It is, therefore, one object of this invention to provide an improved resilient shoe fastening means which tightly adheres to the associated eyelets of the shoe.

Another object of this invention is to provide an improved resilient shoe fastening means for spanning the gap between a given pair of eyelets which together with other similar fastening means when individually fitted to extend between other pairs of eyelets of that shoe replace the ordinary shoe lace.

A further object of this invention is to provide a resilient shoe fastening means adaptable to all shoes regardless of the diameter of the eyelet.

A further object of this invention is to provide an improved ornamental shoe fastening means which when properly fitted between given pairs of eyelet conceal the adjustable gripping means arranged at th ends of the resilient spanning member.

A still further object of this invention is to provide a improved resilient shoe fastening means which employ novel gripping means at each of its ends for gripping th associated eyelets of the shoes on which it is applied.

A still further object of this invention is to provide durable, inexpensive and still attractive resilient sho fastener which may be manufactured in various color to fit any color shoe.

These and other objects and advantages of this inven tion will become more apparent as the description i given and the features of novelty which characteriz this invention will be pointed out with particularity i the claims annexed to and forming a part of this specifi cation.

BRIEF DESCRIPTION OF THE DRAWING

The present invention may be more readily describe by reference to the accompanying drawing of which.

DESCRIPTION OF THE PREFERRED EMBODIMENT

Figure 1:
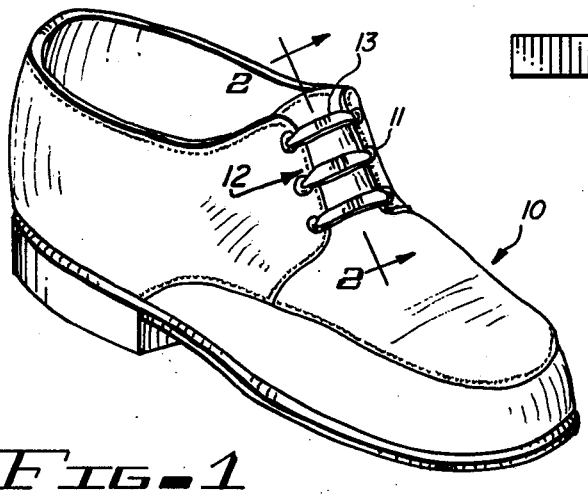
FIG. 1 is a perspective view of a shoe showing plurality of the disclosed fastening means extendin between given sets of eyelets and embodying the inven tion.
Figure 3:
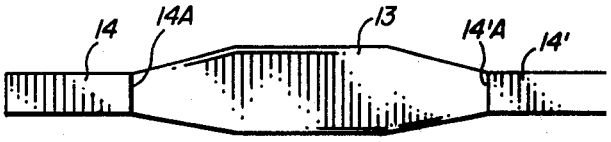
FIG. 3 is a bottom view of the fastening means show in FIGS. 1 and 2.

Referring more particularly to the drawing by char acters of reference, FIG. 1 discloses a conventiona shoe 10 which is representative of any style for mar woman or child. The shoe is provided with the usua pairs of lace receiving eyelets 11. In accordance wit the teachings of this invention, an improved clamping gripping or fastening means 12 is provided to exten between any pair of eyelets 11 whether in the manne shown on the shoe of FIG. 1 or any other combinatio of given pairs of eyelets in the shoe.

Each fastening means comprises a resilient membe 13 extending substantially the full length of the fasten ing means formed out of any suitable material whic will be elastic enough to firmly hold its position whe adjusted to fit between a given set of eyelets but com ıble when the wearer of the shoe bends or twists his er foot. This resilient member may be formed of :rial which is precolored to match the color of the or formed to provided a pleasing color combina- with it.

:GS. 1–8 illustrate that the fastening means are pro- d with eyelet gripping means or plates such as plas- r metallic ends 14, 14′ which are bonded in some ble way such as, for example, by gluing or vulca- g along a part of their lengths to the resilient mem- 13 which comprises a rubber-like material. The :ness of the metallic or plastic ends of the fastening ıs may be greater than, equal to or less than the :ness of the associated resilient member 13 bonded :to.

Figure 2:
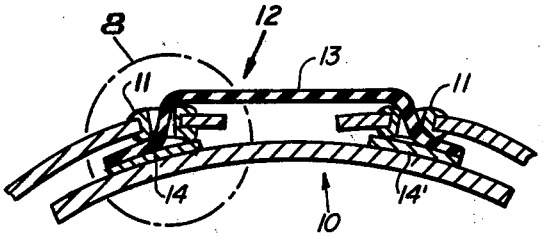
FIG. 2 is a cross-sectional view of FIG. 1 taken alon the line 2—2.
Figure 5:
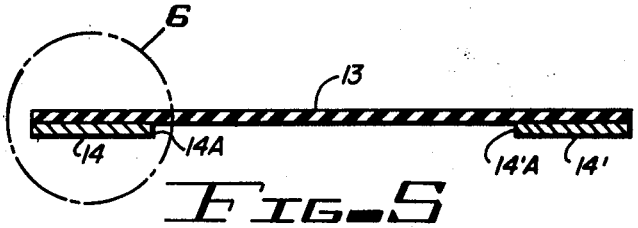
FIG. 5 is a cross-sectional view of the fastenin means shown in FIGS. 1-4.
Figure 6:
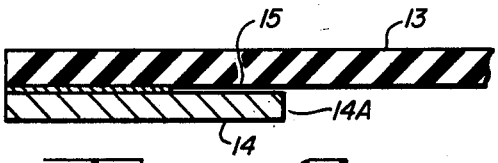
FIG. 6 is an enlargement of the circled area 6 show in FIG. 5.
Figure 7:
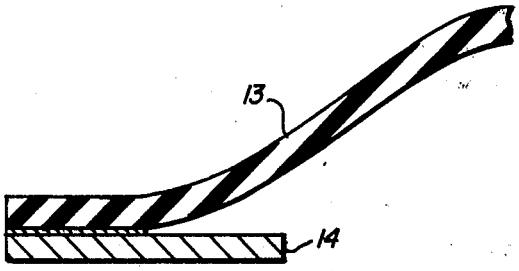
FIG. 7 is a view similar to that shown in FIG. 6 wit the resilient member shown separated from a part of it end member to form a gap for receiving a part of a associated eyelet therebetween.
Figure 8:
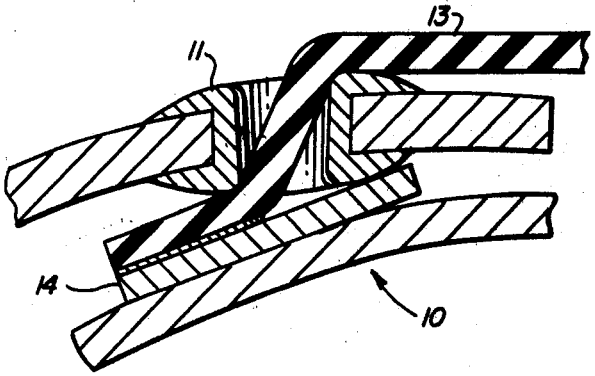
FIG. 8 is an enlarged view of the circled area shown in FIG. 2.

: shown in FIGS. 2 and 5–8, the metallic or plastic 14, 14′ are intentionally unattached, i.e. not bonded ; at least a part of their lengths at their juxtaposi- d ends 14A, 14A′ leaving a gap 15 at these ends een the gripping means or plates 14, 14′ and the ent member 13.

ith this form of connection of ends 14, 14′ to resil- nember 13, the ends 14, 14′ of the fastening means n be inserted through the eyelets 11 of the shoe 10, ɔwn in FIGS. 1 and 2, with the ends 14A and 14′A :tal ends 14, 14′ sliding under the metal eyelets 11. : member 13 is resilient, the ends 14, 14′ of this ıing means draws the unfastened portion of the 14, 14′ toward and underneath the metal eyelets 11. shown in FIGS. 7 and 8 when the fastening means pushed through the eyelet 11 it is forced under the t 11 in a direction away from the associated eyelet : other side of the shoe. The same eyelet inserting ı is undertaken for the other end of the fastening s through the associated eyelet. When the pressure eased on the fastening means during the eyelet ion action the unfastened ends 14A, 14′A of the ing means slides under a part of the periphery of 'elets in the manner shown in FIG. 8 to tightly but etachable manner anchor the resilient member 13 : shoe 10.

ɜ. 9 illustrates a modification of the resilient mem- hown in FIGS. 1–8 wherein the resilient member provided with a plurality of gripping means or 18, 18′ bonded thereto one at each end thereof. gripping means is provided with an unbonded ated end such as ends 19, 19′ which may be pre- d to lie against the common surface of resilient er 17 or bend slightly to form a small acute angle vith. This gripping means may have a width the ɔr smaller than the width of the resilient member ıny point along its length.

ıould be noted that when the plates 18, 18′ of the ng means are forced through the eyelets 11 of the 0, that the bifurcated or notched ends 19, 19′ may ;ed toward each other so as to easily pass through elet. After the bifurcated ends are through the they may then reassume their unbiased position y forming a larger gripping area on the periphery of the eyelet and aid in keeping the fastener secured to the shoe.

Figure 9:
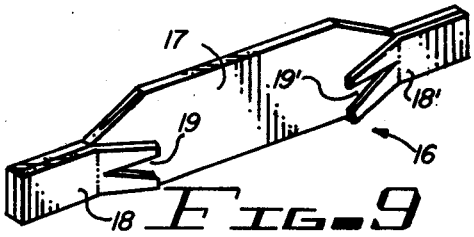
FIG. 9 is a perspective view of a modification of th fastening means shown in FIGS. 1-8 wherein the plate on the ends of the resilient member comprises bifur cated configurations.
Figure 4:
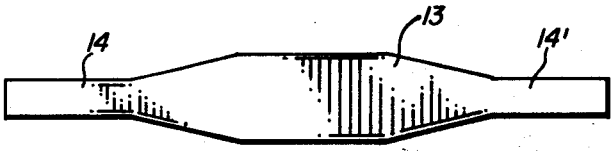
FIG. 4 is a top view of the fastening means shown i FIGS. 1 and 2.
Figure 10:
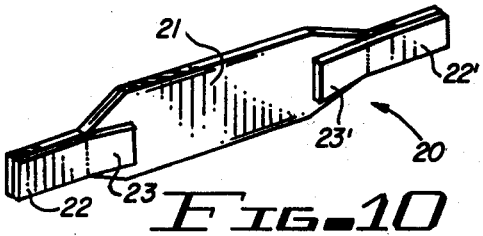
FIG. 10 is a perspective view of a still further modifi cation of the fastening means shown in FIGS. 1- wherein the plates comprise tabs the lose ends of whic extend outwardly of the associated resilient member.

FIG. 10 discloses a further modification of the fastening members shown in FIGS. 1–9 wherein the elongated resilient fastening member 21 is provided with gripping means or plates 22, 22′, bonded one at each end thereof on a common side thereof. The gripping means or plates 22, 22′ have unbonded tabs 23, 23′ at common juxtapositioned ends thereof. These tabs may be wedge shaped, as shown by the general configuration of ends 19, 19′ of the plates 18, 18′ of fastening member 17 of FIG. 9 or may be of the rectangular configuration shown in FIG. 10.

Each of the gripping means 22, 22′ and their associated tabs grip a portion of the periphery of the eyelets in the same manner as disclosed and described for the structures shown in FIGS. 1–9.

As noted from FIGS. 9 and 10 each of the tabs forming the unbonded portion of the gripping means is flexible and small enough to be pulled through the smallest diameter eyelet of the shoes found in the market place.

Although more than one embodiment of the present invention has been illustrated and described, it will be apparent to those skilled in the art that various changes and modifications may be made therein without departing from the spirit of the invention or from the scope of the appended claims.

What is claimed is:

1. A shoe fastener for extending between cooperating pairs of eyelets of the shoe comprising:

a flat resilient elongated member, a pair of gripping members one covering substantially a different end of only one common surface of said resilient member and being bonded thereto along only terminal end parts of their lengths, the second parts of the lengths of said gripping members comprising an unbonded tab portions juxtapositioned to each other along the length of said resilient member, the ends of said resilient member including the gripping members when moved through an eyelet of a shoe causing said resilient member to separate from the associated gripping member along the unbonded portion thereof to form clamps for engaging the periphery of the associated eyelets of the shoe between said resilient member and the said second parts of the gripping members.

2. The shoe fastener set forth in claim 1 wherein:

each gripping member is formed of a metallic material.

3. The shoe fastener set forth in claim 1 wherein:

each gripping member is formed of a plastic material.

4. The shoe fastener set forth in claim 1 wherein:

said second parts of each of said gripping members comprises a bifurcated configuration extending outwardly of said common surface and forming an acute angle therewith, said bifurcated configuration forming a pair of resilient legs which are biased toward each other when passed through the associated eyelet of the shoe.

* * * * *